US010593462B2

(12) United States Patent
Han et al.

(10) Patent No.: US 10,593,462 B2
(45) Date of Patent: Mar. 17, 2020

(54) INDUCTOR DEVICE

(71) Applicant: Samsung Electronics Co., Ltd., Gyeonggi-do (KR)

(72) Inventors: Yun-Hui Han, Gyeonggi-do (KR); Kisun Lee, Gyeonggi-do (KR); Chul-Woo Park, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/928,695

(22) Filed: Oct. 30, 2015

(65) Prior Publication Data

US 2016/0126000 A1 May 5, 2016

(30) Foreign Application Priority Data

Oct. 30, 2014 (KR) ..... 10-2014-0148877

(51) Int. Cl.

| | |
|---|---|
| ***H01F 27/28*** | (2006.01) |
| ***H01F 17/00*** | (2006.01) |
| ***H01F 17/04*** | (2006.01) |
| *H01F 27/38* | (2006.01) |
| *H01F 3/10* | (2006.01) |

(52) U.S. Cl.

CPC ..... *H01F 27/28* (2013.01); *H01F 17/0013* (2013.01); *H01F 17/0033* (2013.01); *H01F 17/04* (2013.01); *H01F 27/38* (2013.01); *H01F 2003/106* (2013.01); *H01F 2017/048* (2013.01)

(58) Field of Classification Search

CPC ..... H01F 27/28

See application file for complete search history.

(56) References Cited

U.S. PATENT DOCUMENTS 4,425,511 A * 1/1984 Brosh ..... H03K 17/97 307/106
5,552,756 A * 9/1996 Ushiro ..... H01F 17/0013 336/200
6,097,273 A * 8/2000 Frye ..... H01F 5/003 333/25
6,476,689 B1 * 11/2002 Uchida ..... H03H 1/0007 333/177

(Continued)

FOREIGN PATENT DOCUMENTS

CN 1434468 8/2003
CN 1860562 11/2006

(Continued)

OTHER PUBLICATIONS

European Search Report dated May 9, 2016 issued in counterpart application No. 15192454.5-1556, 8 pages.

(Continued)

*Primary Examiner* — Mang Tin Bik Lian
*Assistant Examiner* — Malcolm Barnes
(74) *Attorney, Agent, or Firm* — The Farrell Law Firm, P.C.

(57) ABSTRACT

An inductor device is provided. The inductor device includes a coil unit that includes a pair of first and second coils disposed adjacent to each other and coupled to each other, a core unit that surrounds inner and outer spaces of the coil unit, and an induction unit that is disposed in the coil unit and is induced by a magnetic field generated between the first and second coils.

4 Claims, 12 Drawing Sheets

(56) References Cited

U.S. PATENT DOCUMENTS 6,842,158 B2 * 1/2005 Jo ..... H01Q 1/243 343/700 MS
7,875,955 B1 * 1/2011 Hopper ..... H01F 17/0006 257/516
2001/0030593 A1 * 10/2001 Imada ..... H01F 17/0013 336/200
2003/0117227 A1 * 6/2003 Escalera ..... H01P 5/10 333/26
2003/0137384 A1 * 7/2003 Itou ..... H01F 17/0013 336/200
2004/0252596 A1 * 12/2004 Cho ..... H01F 5/003 369/44.12
2007/0057755 A1 * 3/2007 Suzuki ..... H01F 17/0013 336/200
2007/0139151 A1 * 6/2007 Nussbaum ..... H01F 17/0013 336/200
2012/0131792 A1 5/2012 Tseng
2013/0063237 A1 * 3/2013 Morimoto ..... H01F 3/06 336/170
2013/0076474 A1 * 3/2013 Chang ..... H01F 17/0013 336/200
2013/0106500 A1 5/2013 Yin et al.
2013/0194060 A1 8/2013 Nakada et al.
2014/0049350 A1 * 2/2014 Tseng ..... H01F 41/046 336/200
2014/0062639 A1 3/2014 Sasamori et al.
2014/0062640 A1 3/2014 Sasamori et al.
2014/0072849 A1 3/2014 Nitta et al.

FOREIGN PATENT DOCUMENTS

CN 102479611 5/2012
JP 2-305413 12/1990
JP 6-176928 6/1994
JP 2008-300432 12/2008
KR 10-2013-0023043 3/2013
KR 10-2014-0026775 3/2014
KR 10-2014-0032325 3/2014
KR 10-2014-0032326 3/2014
KR 10-2014-0035249 3/2014

OTHER PUBLICATIONS

Chinese Office Action dated Jun. 5, 2018 issued in counterpart application No. 201510729579.X, 16 pages.

* cited by examiner

INDUCTOR DEVICE

PRIORITY

This application claims priority under 35 U.S.C. § 119(a) to Korean Application Serial No. 10-2014-0148877, which was filed in the Korean Intellectual Property Office on Oct. 30, 2014, the entire content of which is incorporated herein by reference.

BACKGROUND OF THE INVENTION

1. Field of the Invention

The present invention relates generally to an inductor device, and more particularly, to an inductor device including a 2-in-1 coil structure.

2. Description of the Related Art

An inductor device serves to not only remove noise, but also stores energy or regulates current. Such an inductor device may be divided into several types, for example, according to the type of core used in the inductor or according to the method of winding a coil around the core. The inductor device may also be divided into a general inductor and a chip type inductor (hereinafter referred to as "chip inductor") according to the size of the inductor. In addition, the chip inductor may be further divided into a winding type inductor and a laminated type inductor according to a coil provided in the inductor.

On one hand, a reduction in the size or weight of an inductor device has a limitation in improving efficiency or thermal issues. On the other hand, in terms of efficiency or thermal issues, there is a limitation in reducing the size or weight of an inductor device.

To improve efficiency and the response time to a change in current, a coupled inductor including a plurality of inductors coupled to each other may be used in large-scale power equipment. However, since this coupled inductor is large in size, it is often difficult to apply the coupled inductor structure to an electronic device that is slim and light, for example, a portable communication device or the like.

SUMMARY OF THE INVENTION

The present invention has been made to address at least the above mentioned problems and/or disadvantages and to provide at least the advantages described below.

An aspect of the present invention provides an inductor device. The inductor device includes a coil unit that includes a pair of first and second coils disposed adjacent to each other and coupled to each other, a core unit that surrounds inner and outer spaces of the coil unit, and an induction unit that is disposed in the coil unit and is induced by a magnetic field generated between the first and second coils.

An aspect of the present invention provides an inductor device. The inductor device includes a first coil that has a first winding section wound in a first direction, a second coil that is disposed adjacent to the first coil and has a second winding section wound in a second direction that is opposite to the first direction of the first winding section, a core unit that surrounds inner and outer spaces of the first and second coils, and an induction unit that is induced by a magnetic field generated between the first and second coils and is formed such that a first side of the induction unit is wound along the first winding section of the first coil, a second side of the induction unit is wound along the second winding section of the second coil, and both the first and second sides of the induction unit are connected to each other between the first and second coils.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION OF EMBODIMENTS OF THE PRESENT INVENTION

Figure 1:
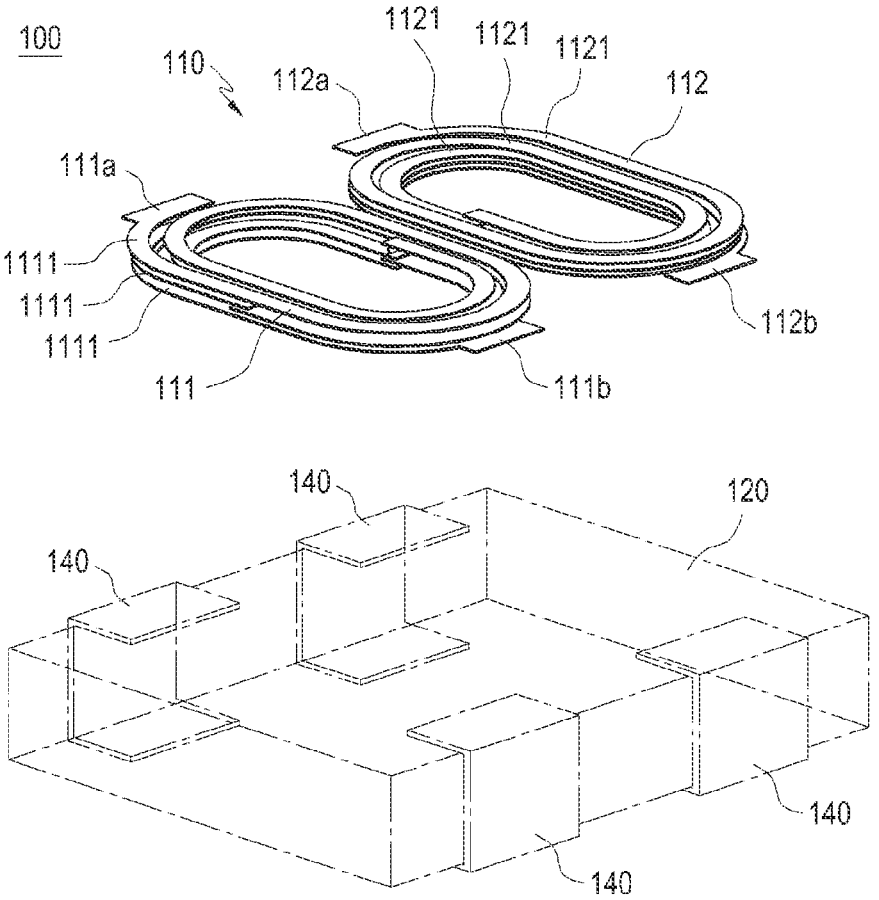
FIG. 1 is a perspective view illustrating an inductor device having a 2-in-1 structure, according to an embodiment of the present invention.

Various embodiments of the present invention will now be described more fully in conjunction with the accompanying drawings. The present invention may have various embodiments, and modifications and changes may be made therein. Therefore, the present invention will be described in detail with reference to particular embodiments shown in the accompanying drawings. However, it should be understood that there is no intent to limit various embodiments of the present invention to the particular embodiments disclosed herein, but the present invention should be construed to cover all modifications, equivalents, and/or alternatives falling within the spirit and scope of the various embodiments of the present invention. In the description of the drawings, identical or similar reference numerals are used to designate identical or similar elements.

As used herein, the expressions "include", "may include", and other conjugates refer to the existence of a corresponding disclosed function, operation, or constituent element, and do not limit one or more additional functions, operations, or constituent elements. Further, as used in various embodiments of the present invention, the terms "include", "have", and their conjugates may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

Further, as used herein, the expression "or" includes any or all combinations of words enumerated together. For example, the expression "A or B" may include A, may include B, or may include both A and B.

While expressions including ordinal numbers, such as "first" and "second", as used herein, may modify various constituent elements, such constituent elements are not limited by the above expressions. For example, the above expressions do not limit the sequence and/or importance of the corresponding elements. The expressions may be used to distinguish an element from another element. For example, a first user device and a second user device indicate different user devices although both of them are user devices. For example, a first element may be referred to as a second element, and likewise a second element may also be referred to as a first element without departing from the scope of various embodiments of the present disclosure.

It should be noted that if it is described that an element is "coupled" or "connected" to another element, the first element may be directly coupled or connected to the second element, and a third element may be "coupled" or "connected" between the first and second elements. Contrarily, when an element is "directly coupled" or "directly connected" to another element, it may be construed that a third element does not exist between the first element and the second element.

The terms as used herein are merely for the purpose of describing particular embodiments and are not intended to limit the various embodiments of the present invention. As used herein, the singular forms are intended to include the plural forms as well, unless the context clearly indicates otherwise.

Unless defined otherwise, all terms used herein, including technical terms and scientific terms, have the same meaning as commonly understood by a person of ordinary skill in the art to which various embodiments of the present disclosure pertain. Such terms as those defined in a generally used dictionary are to be interpreted to have the meanings equal to the contextual meanings in the relevant field of art, and are not to be interpreted to have ideal or excessively formal meanings unless clearly defined.

An electronic device according to embodiments of the present invention may be a device having a function that is provided through various colors emitted depending on the states of the electronic device or a function of sensing a gesture or bio-signal. For example, the electronic device described herein may be embodied in the form of one of a smart phone, a tablet personal computer (PC), a mobile phone, a video phone, an e-book reader, a desktop PC, a laptop PC, a netbook computer, a personal digital assistant (PDA), a portable multimedia player (PMP), a MP3 player, a mobile medical appliance, a camera, a wearable device (e.g., head-mounted-device (HMD) such as electronic eyeglasses, electronic clothes, an electronic bracelet, an electronic necklace, an electronic appcessory, an electronic tattoo, or a smart watch).

The electronic device may be a smart home appliance having a function serviced by light that emits various colors depending on the states of the electronic device or a function of sensing a gesture or bio-signal. The smart home appliance may, for example, be embodied in the form of one of a television, a digital video disk (DVD) player, an audio player, a refrigerator, an air conditioner, a cleaner, an oven, a microwave, a washing machine, an air purifier, a set-top box, a TV box (e.g., HomeSync™ of Samsung, Apple TV™, or Google TV™), a game console, an electronic dictionary, an electronic key, a camcorder, and an electronic frame.

The electronic device may be embodied in the form of one of various medical appliances (e.g., magnetic resonance angiography (MRA), magnetic resonance imaging (MRI), computed tomography (CT), and ultrasonic equipment), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) device of a shop or store.

The electronic device may be embodied in the form of one of a part of furniture or a building/structure, an electronic board, an electronic signature receiving device, a projector, and various kinds of measuring instruments (e.g., a water meter, an electric meter, a gas meter, and a radio wave meter), each of which has a function that is provided through various colors emitted depending on the states of the electronic device or a function of sensing a gesture or bio-signal.

The electronic device may be a combination of one or more of the aforementioned various devices. Further, the electronic device may be a flexible device. Further, it will be apparent to those skilled in the art that the electronic device is not limited to the aforementioned devices.

Hereinafter, a chip inductor according to the present invention will be discussed with reference to the accompanying drawings. The term "user" as used herein may refer to a person who uses an electronic device or a device (e.g., artificial intelligence electronic device) that uses an electronic device.

Figure 2:
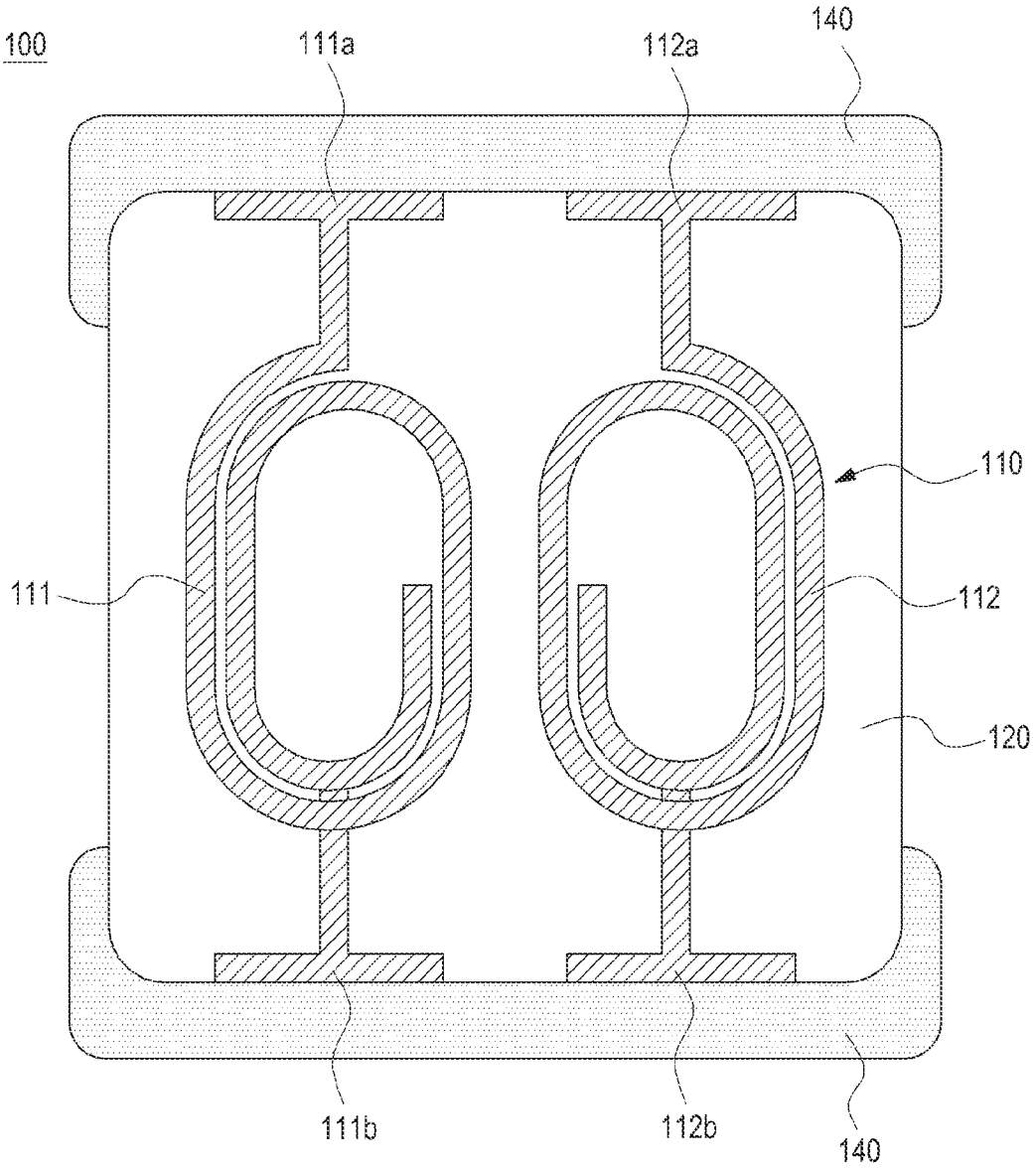
FIG. 2 is a plan view illustrating an inductor device, according to an embodiment of the present invention.

FIG. 1 is a perspective view illustrating an inductor device 100 having a 2-in-1 structure, and FIG. 2 is a plan view illustrating the inductor device 100 shown in FIG. 1, according to an embodiment of the present invention. Referring to FIGS. 1 and 2, the inductor device 100 includes a coil unit 110 and a core unit 120, and may further include induction units 130A, 130B, 130C, 130D, 130E, and 130F (see FIGS. 3A-8C), as described below.

The coil unit 110 includes a first coil 111 and a second coil 112. The first coil 111 and the second coil 112 may be disposed adjacent to each other and coupled to each other. The inner and outer spaces of the first and second coils 111, 112, which are disposed adjacent to each other, may be surrounded by the core unit 120. The first coil 111 may be wound within the core unit 120, and a start point 111*a* and an end point 111*b* of the first coil 111 may be connected to external terminals 140 which are oppositely mounted at both ends of the core unit 120. The second coil 112 may be wound adjacent to the first coil 111 within the core unit 120, and a start point 112*a* and an end point 112*b* of the second coil 112 may be connected to external terminals 140. As described above, the coil unit 110 may have a 2-in-1 structure in which the first and second coils 111, 112, respectively, are disposed adjacent to each other within the core unit 120.

The first and second coils 111, 112 may be wound in different directions while having a predetermined shape such as a circular shape, an elliptical shape, or the like. The first coil 111 includes a first winding section 1111 that has two lines wound in one direction, particularly, in the counter-clockwise direction. The second coil 112 includes a second winding section 1121 that has two lines wound in the opposite direction to the first coil 111, particularly, in the clockwise direction (see also FIGS. 2-8C). As an example, it will be assumed in the following description that each of the first winding section 1111 of the first coil 111 and the second winding section 1121 of the second coil 112 has two lines that are laminated in the thickness direction. However, the first winding section 1111 of the first coil 111 and the second winding section 1121 of the second coil 112 are not limited thereto in terms of the winding shape, the number of lines, the lamination shape, and the like. For example, the first winding section 1111 and the second winding section 1121 may have one line, may be wound in the form of a spring, and may also be changed or modified in various manners.

The external terminals 140 may be mounted on both opposite sides of the core unit 120. The start points 111*a*, 112*a* and end points 111*b*, 112*b* of the coil unit 110 may be electrically connected to the external terminals 140, respectively. That is, the start point 111*a* of the first coil 111 and the start point 112*a* of the second coil 112 may be electrically connected to the external terminals 140 mounted on one side of the core unit 120. Further, the end point 111*b* of the first coil 111 and the end point 112*b* of the second coil 112 may be electrically connected to the external terminals 140 mounted on the other side of the core unit 120, which is opposite to the one side of the core unit 120. The core unit 120 may serve as a space for forming a magnetic path through which magnetic fluxes, induced in internal electrodes as current is applied to the external terminals 140, pass, and may be made of a material having high magnetic permeability, such as a ceramic material, a ferrite material, or a combination thereof. The core unit 120 may also be made of a metal alloy. Although the core unit 120 has been described as being made of a ceramic material, a ferrite material, a combination thereof, or a metal alloy by way of example, the material of the core unit 120 is not limited thereto. Other materials having high permeability may be used as the material of the core unit 120 so long as the core unit 120 can form a magnetic path as current is applied to the external terminals 140.

The above-described inductor device 100 that has a core unit 120 and a coil unit 110 including the first coil and second coil 111, 112 within the core unit 120 may be a chip inductor. When the inductor device 100 is implemented as a chip inductor, the core unit 120 surrounding the inner spaces of the first coil and second coil 111, 112 may be formed as an electrode body within which a pair of internal electrodes in the form of the first coil and second coil 111, 112 are provided. In addition, the internal electrodes may be provided with connection electrodes (corresponding to the above-mentioned start and end points 111*a*, 112*a* and 111*b*, 112*b*, respectively) that are mounted opposite to the internal electrodes and are connected to the external terminals 140. When the inductor device 100 is implemented as a chip inductor, the internal electrodes may be formed of a first internal electrode (hereinafter referred to as "first coil 111") including a first winding section 1111 that has two lines wound in one direction and a second internal electrode (hereinafter referred to as "second coil 112") disposed adjacent to the first coil 111 and including a second winding section 1121 wound in the opposite direction to the first coil 111.

Reference will now be made to FIGS. 3A-8C showing various examples of induction units 130A, 130B, 130C, 130D, 130E, and 130F that may be included in the above-described inductor device 100.

Hereinafter, the various examples of the induction units 130A, 130B, 130C, 130D, 130E, and 130F will be described with reference to the drawings 3A-8C.

Figure 3A:
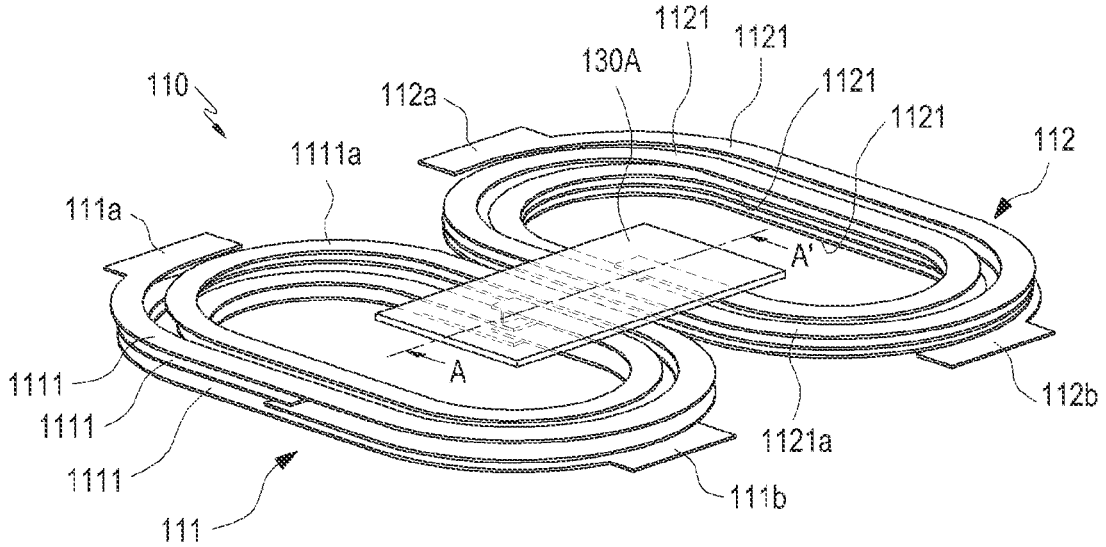
FIG. 3A is a perspective view illustrating a coil unit including an induction unit of an inductor device, according to an embodiment of the present invention.
Figure 3B:
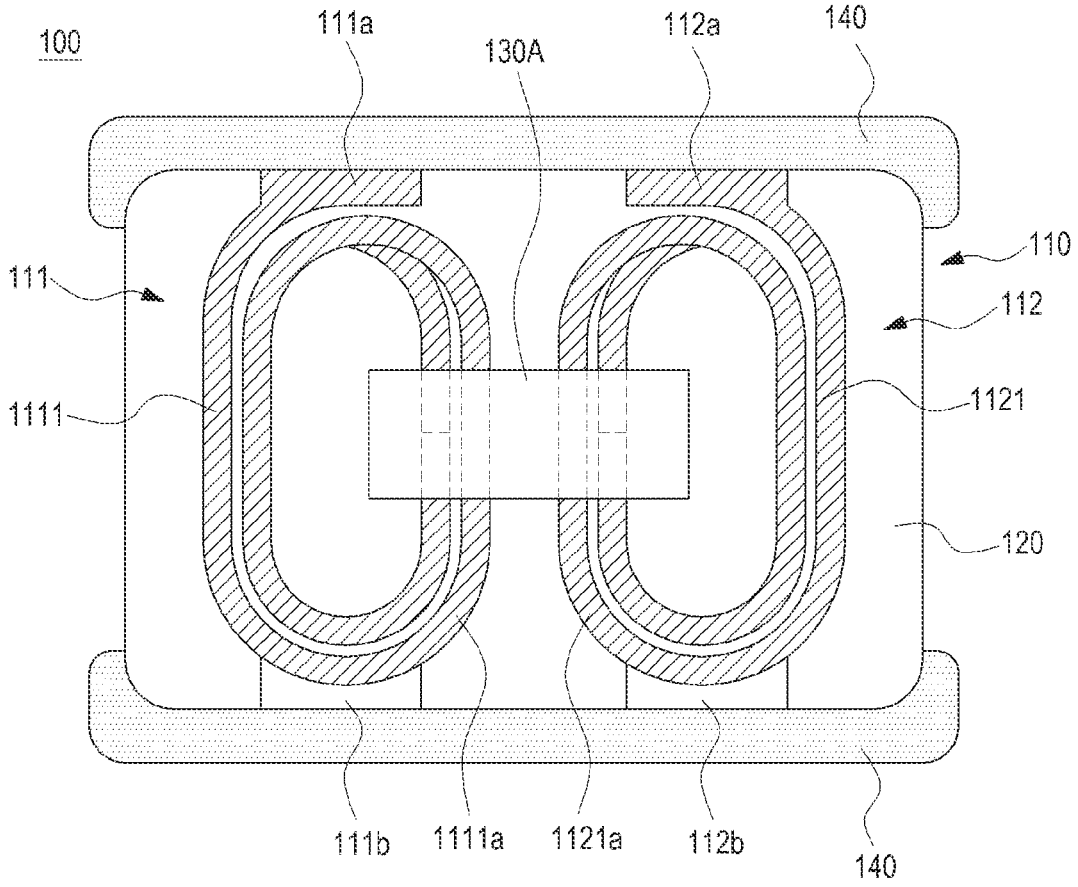
FIG. 3B is a plan view illustrating the inductor device including the coil unit and induction unit shown in FIG. 3A, according to an embodiment of the present invention.
Figure 3C:
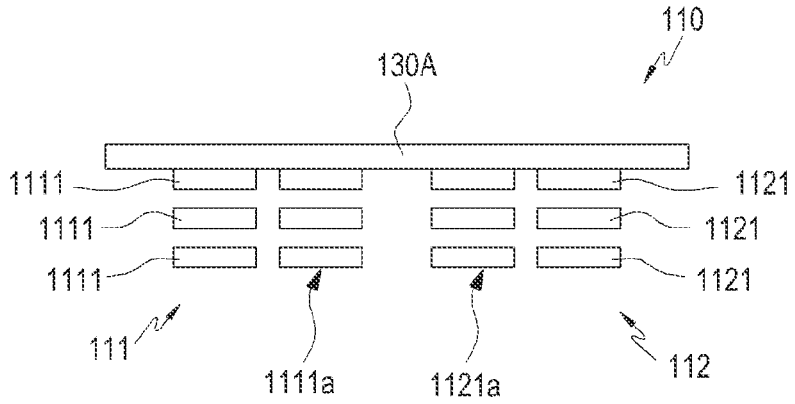
FIG. 3C is a side view illustrating the coil unit and induction unit shown in FIG. 3A, according to an embodiment of the present invention.

FIG. 3A is a perspective view illustrating the coil unit 110 including the induction unit 130A, FIG. 3B is a plan view illustrating the inductor device 100 including the coil unit 110 and induction unit 130A shown in FIG. 3A, and FIG. 3C is a side view illustrating the coil unit and induction unit 130A shown in FIG. 3A, according to an embodiment of the present invention.

Referring to FIGS. 3A-3C, the induction unit 130A is capable of being induced by a magnetic field and is mounted on the coil unit 110 in the inductor device 100, described above with reference to FIGS. 1 and 2.

The induction unit 130A may be formed as a plate-like member. The induction unit 130A may be positioned on at least one side of the coil unit 110 and, in particular, may be positioned in such a manner as to connect adjacent portions of the first coil and second coil 111, 112 to each other. More specifically, the induction unit 130A may be positioned such that it is placed on, under, and/or between a portion of the first winding section 1111 where the first coil 111 is adjacent to the second coil 112 (hereinafter referred to as "second winding section-adjacent portion 1111*a*") and a portion of the second winding section 1121 where the second coil 112 is adjacent to the first coil 111 (hereinafter referred to as "first winding section-adjacent portion 1121*a*") and connects the second winding section-adjacent portion 1111*a* and the first winding section-adjacent portion 1121*a* to each other. That is, the induction unit 130A may be positioned on the upper surfaces of the second winding section-adjacent portion 1111*a* and the first winding section-adjacent portion 1121*a*, on the lower surfaces of second winding section-adjacent portion 1111*a* and the first winding section-adjacent portion 1121*a*, or between windings of the second winding section-adjacent portion 1111*a* and between windings of the first winding section-adjacent portion 1121*a*. As an example, it will be assumed in the following description that the induction unit 130A is positioned on the upper surfaces of the second winding section-adjacent portion 1111*a* and the first winding section-adjacent portion 1121*a*. However, as described above, the induction unit 130A may be positioned on the lower surfaces of the second winding section-adjacent portion 1111*a* and the first winding section-adjacent portion 1121*a*, or may be positioned in such a manner as to pass through (or between) the second winding section-adjacent portion 1111*a* and the first winding section-adjacent portion 1121*a*.

The induction unit 130A may be made of a ferrite material, a metal alloy, or a combination thereof so that the induction unit 130A may be induced by magnetic fields generated in the first and second coils 111, 112. However, the material of the induction unit 130A is not limited thereto, and any changes or modifications may be made therein so long as the induction unit 130A is made of a material having good magnetic permeability and thus having high inductance of magnetic fields of the first coil and second coil 111, 112.

Since the induction unit 130A is positioned on the upper surfaces of the second winding section-adjacent portion 1111*a* and the first winding section-adjacent portion 1121*a* and connects them to each other, the induction unit 130A can be induced by a magnetic field generated between the first and second coils 111, 112. The induction unit 130A is induced not only by a magnetic field generated by the first coil 111, but also by a self-magnetic field generated by the second coil 112, and these two magnetic fields are mutually compensated in the induction unit 130A. Accordingly, the inductance of the inductor device 100 can be increased as a result of being induced by both the magnetic field generated by the first coil 111 and the self-magnetic field generated by the second coil 112. When the inductor device 100 has a 2-in-1 structure and is relatively small in size, as is the case of the inductor device 100, the induction unit 130A that is positioned on one side of the coil unit 110, in such a manner as to couple the coils of the coil unit 110, can increase the inductance of the inductor device 100. Further, in the inductor device 100 including the induction unit 130A, a reduction in inductor voltage ripple, as well as a reduction in inductor current ripple, can be achieved by the induction unit 130A. Therefore, the efficiency of the inductor device 100 can be increased through using the induction unit 130A. In addition, since the inductor device 100 including the induction unit 130A can be mounted in a small-sized electronic device with limited mounting space, such as a portable terminal device efficiency of the electronic device is increased when compared to conventional electronic devices.

Figure 3D:
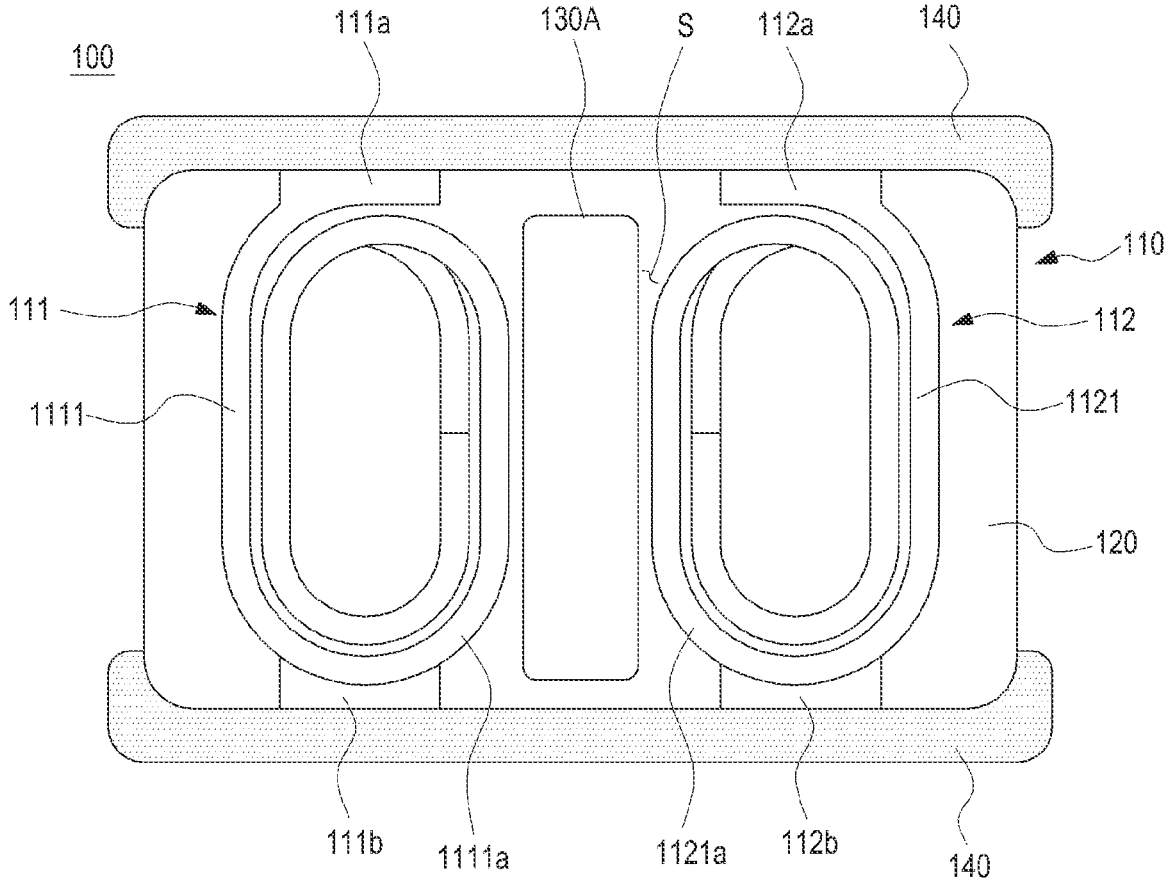
FIG. 3D is a plan view illustrating the inductor device including the coil unit and a modified induction unit, according to an embodiment of the present invention.

FIG. 3D is a plan view illustrating the inductor device 100 including the coil unit and a modified induction unit 130A, according to an embodiment of the present invention.

Referring to FIG. 3D, the induction unit 130A may be positioned in a mounting space "S" between the first and second coils 111, 112. Since the induction unit 130A is placed in a space between the first coil and second coil 111, 112, it can be induced by a magnetic field generated between the first coil and second coil 111, 112. The induction unit 130A illustrated in FIG. 3D may be made from the same materials as described above with respect to the induction unit 130A described above with respect to FIGS. 3A-3C.

Since the induction unit 130A illustrated in FIG. 3D is positioned in a space between the second winding section-adjacent portion 1111*a* and the first winding section-adjacent portion 1121*a*, it can couple the first coil and second coil 111, 112 to each other and can be induced by a magnetic field generated between the first coil and second coil 111, 112. Accordingly, the same benefits can be obtained for electronic device 100 using the induction unit 130A shown in FIG. 3D as those obtained using the induction unit 130A described with reference to FIG. 3A-3C.

Figure 4A:
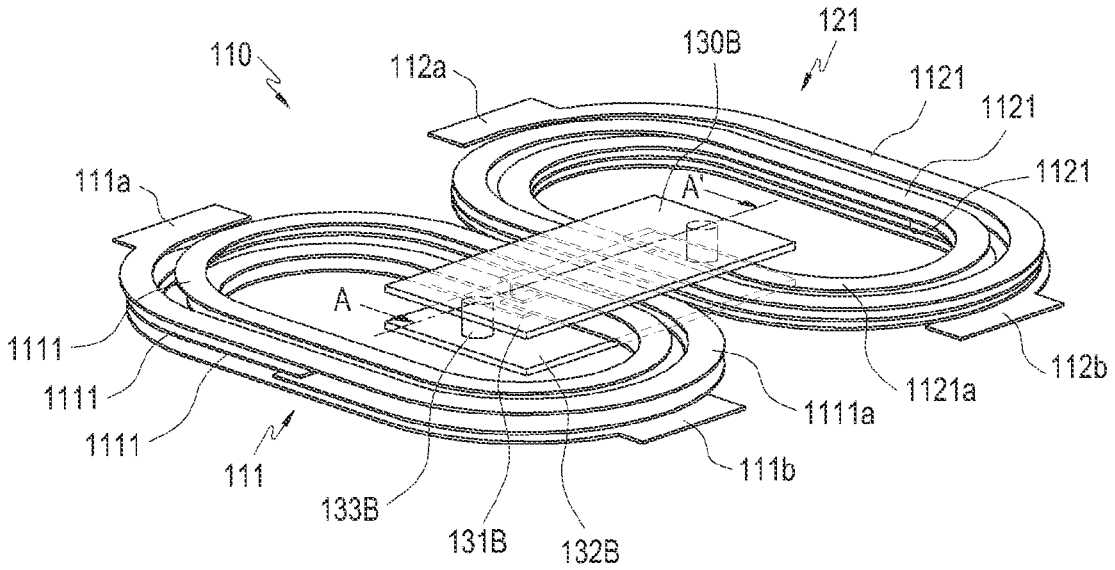
FIG. 4A is a perspective view illustrating the coil unit including an induction unit, according to an embodiment of the present invention.
Figure 4B:
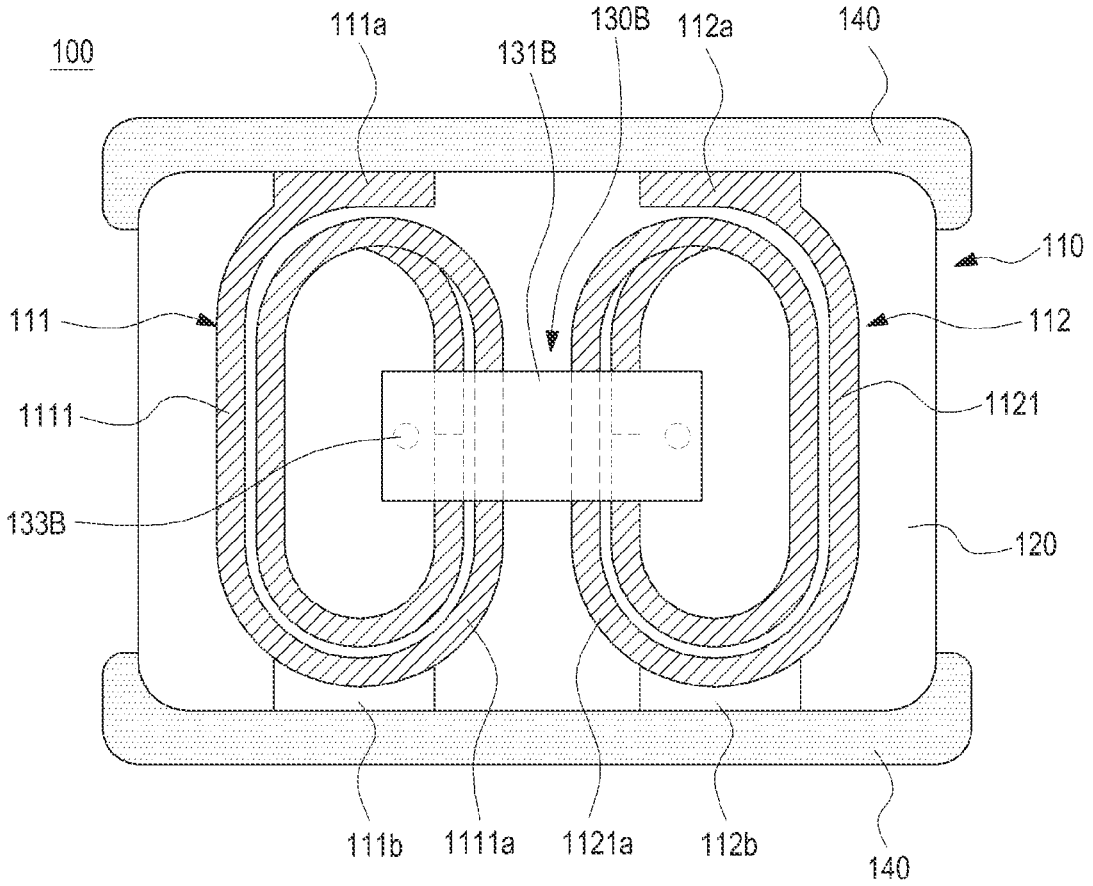
FIG. 4B is a plan view illustrating the inductor device including the coil unit and induction unit shown in FIG. 4A, according to an embodiment of the present invention.
Figure 4C:
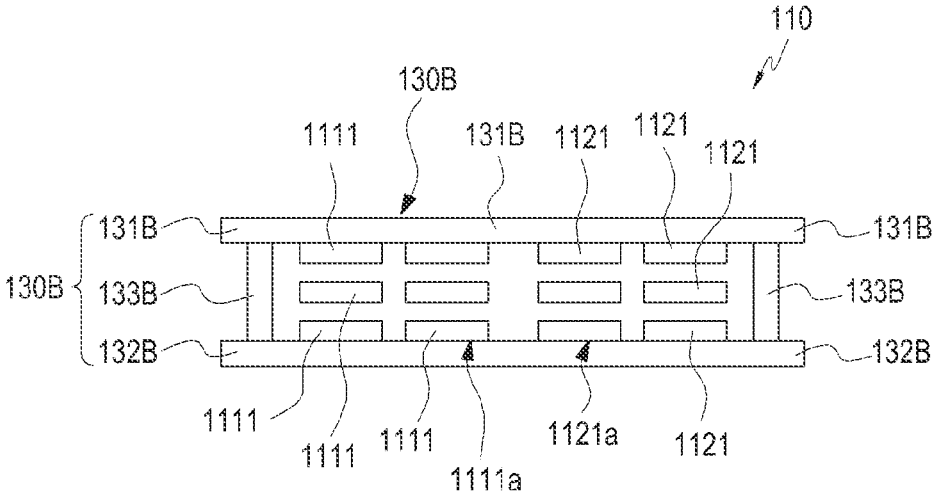
FIG. 4C is a side view illustrating the coil unit and induction unit shown in FIG. 4A, according to an embodiment of the present invention.

FIG. 4A is a perspective view illustrating the coil unit 110 including an induction unit 130B, FIG. 4B is a plan view illustrating the inductor device 100 including the coil unit 110 and induction unit 130B shown in FIG. 4A, and FIG. 4C is a side view illustrating the coil unit 110 and induction unit 130B shown in FIG. 4A, according to an embodiment of the present invention.

Referring to FIGS. 4A-4C, the induction unit 130B may be formed as a ring-type coupling member in the shape of a closed loop. The induction unit 130B may be configured to surround the second winding section-adjacent portion 1111*a* and the first winding section-adjacent portion 1121*a*. More specifically, the first winding section 1111 in which a plurality of windings are wound or laminated may have an inner space. Further, the second winding section 1121 in which a plurality of windings are wound or laminated may also have an inner space. The induction unit 130B may be in the form of a ring that extends over the upper and lower surfaces of the second winding section-adjacent portion 1111*a* and the first winding section-adjacent portion 1121*a* and passes through the inner spaces of the first winding section 1111 and the second winding section 1121.

The induction unit 130B includes a pair of plate portions 131B, 132B and a pair of connection portions 133B connected to the pair of plate portions 131B, 132B. The pair of plate portions 131B, 132B may be positioned opposite to each other, that is, one of the plate portions 131B, 132B may be positioned on the upper surfaces of the second winding section-adjacent portion 1111*a* and the first winding section-adjacent portion 1121*a*, and the other may be positioned on the lower surfaces of the second winding section-adjacent portion 1111*a* and the first winding section-adjacent portion 1121*a*. The pair of connection portions 133B may be designed to pass through the inners spaces of the first winding section 1111 and the second winding section 1121 and connect the opposite plate portions 131B, 132B positioned on the upper and lower surfaces of the second winding section-adjacent portion 1111*a* and the first winding section-adjacent portion 1121*a* respectively. As an example, it will be assumed in the following description that the pair of plate portions 131B, 132B have a wide rectangular shape, and the pair of connection portions 133B have a generally cylindrical shape forming a column so as to connect and support the plate portions 131B, 132B positioned on the upper and lower surfaces of the first and second coils 111, 112. Accordingly, the second winding section-adjacent portion 1111*a* and the first winding section-adjacent portion 1121*a* may be designed to be positioned within a ring-shaped space formed by the pair of plate portions 131B, 132B and the pair of connection portions 133B. Although the induction unit 130B has been described as including a pair of rectangular-shaped plate portions 131B, 132B and a pair of column-shaped connection portions 133B, the shape or form of the induction unit 130B is not limited thereto. For example, the induction unit 130B may be in the form of a rectangular column having a hollow inner space. Accordingly, the second winding section-adjacent portion 1111*a* and the first winding section-adjacent portion 1121*a* may be designed to pass through the hollow inner space of the rectangular column. That is, any modifications or changes may be made in the shape or form of the induction unit 130B so long as t induction unit 130B can couple the first coil and second coil 111, 1112 while surrounding the second winding section-adjacent portion 1111*a* and the first winding section-adjacent portion 1121*a*. The induction unit 130B may be made from any of the aforementioned materials previously described with respect to the induction member 130A.

The induction unit 130B surrounding the second winding section-adjacent portion 1111*a* and the first winding section-adjacent portion 1121*a* can couple the first coil and second coil 111, 112 to each other and can be induced by a magnetic field generated between the first coil and second coil 111, 112. A magnetic field induced from the first coil 111 into the induction unit 130B and a self-magnetic field generated in the second coil 112 are mutually compensated in the induction unit 130B, and, therefore, the inductance of the inductor device 100 can be increased. When the inductor device 100 has a 2-in-1 structure and is relatively small in size, the induction unit 130B that is configured to surround the second winding section-adjacent portion 1111*a* and the first winding section-adjacent portion 1121*a* can increase the inductance of the inductor device 100. Further, the inductor device 100 including the induction unit 130B can achieve a reduction in inductor voltage ripple as well as a reduction in inductor current ripple. Accordingly, the efficiency of the small-sized inductor device 100 including the induction unit 130B can be increased when compared to conventional small-sized inductor devices.

Figure 5A:
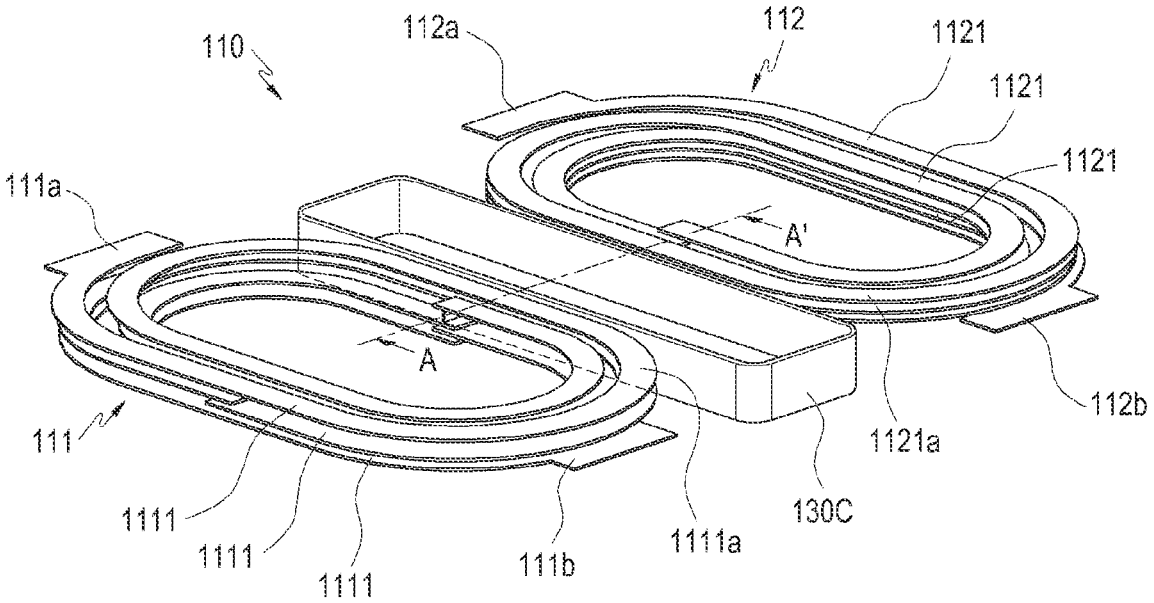
FIG. 5A is a perspective view illustrating the coil unit including an induction unit, according to an embodiment of the present invention.
Figure 5B:
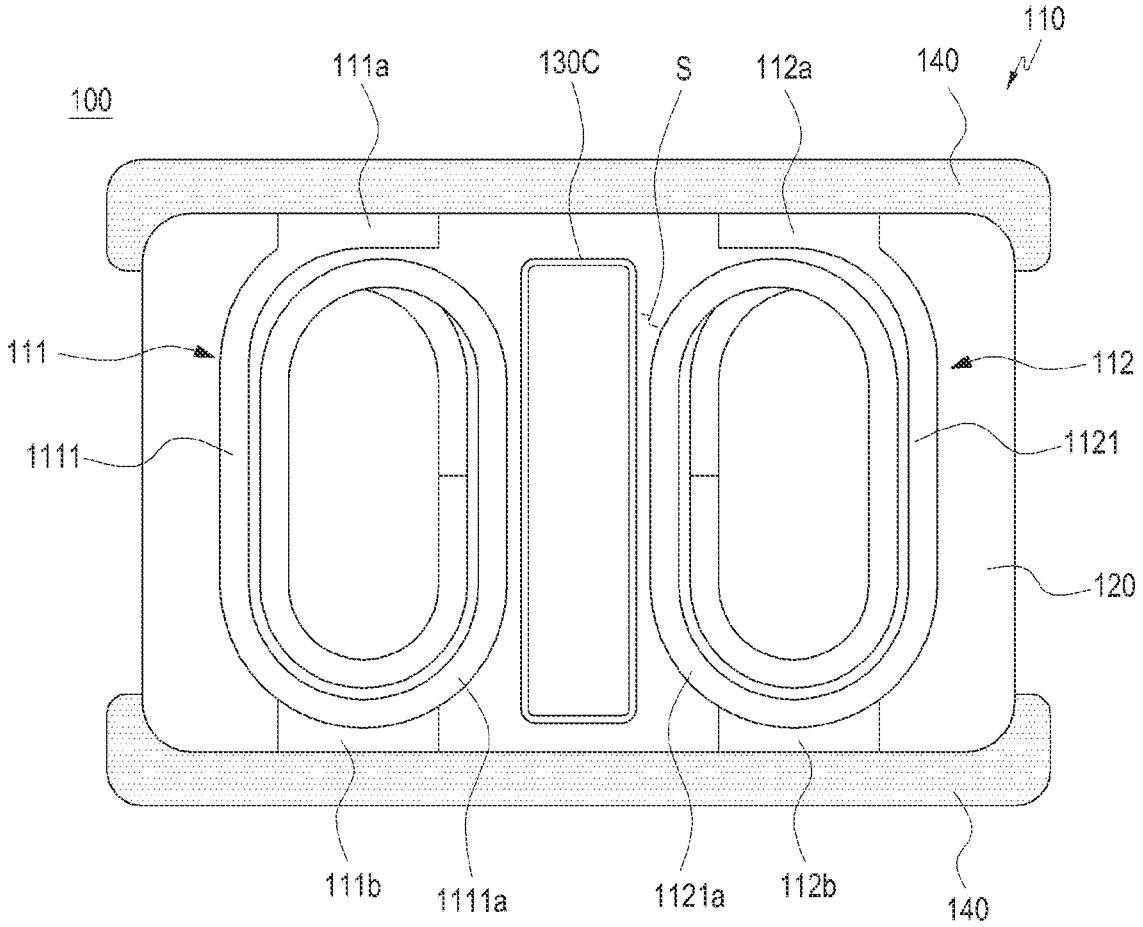
FIG. 5B is a plan view illustrating the inductor device including the coil unit and induction unit shown in FIG. 5A, according to an embodiment of the present invention.
Figure 5C:
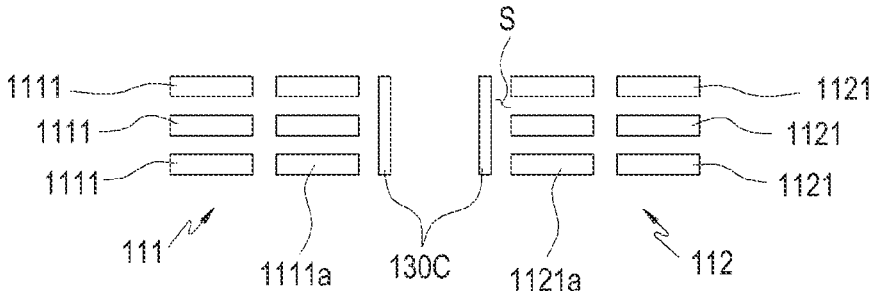
FIG. 5C is a side view illustrating the coil unit and induction unit shown in FIG. 5A, according to an embodiment of the present invention.

FIG. 5A is a perspective view illustrating the coil unit 110 including an induction unit 130C, FIG. 5B is a plan view illustrating the inductor device 100 including the coil unit 110 and induction unit 130C shown in FIG. 5A, and FIG. 5C is a side view illustrating the coil unit 110 and induction unit 130C shown in FIG. 5A, according to an embodiment of the present invention.

Referring to FIGS. 5A 5C, the induction unit 130C may be formed as a ring-type coupling member that is positioned in a space between the first coil and second coil 111, 112 and is in the shape of a closed loop, particularly, an inner closed loop.

The induction unit 130C may be positioned in the mounting space between the second winding section-adjacent portion 1111*a* and the first winding section-adjacent portion 1121*a* and may be in the form of a ring having a hollow inner space. As an example, it will be assumed in the following description that the induction unit 130C is in the form of a ring positioned in the space between the second winding section-adjacent portion 1111*a* and the first winding section-adjacent portion 1121*a*. However, the shape or form of the induction unit 130C is not limited thereto. Any changes or modifications may be made in the shape or form of the induction unit 130C. For example, the induction unit 130C may be in the form of a plate or a hollow box positioned in the mounting space between the second winding section-adjacent portion 1111*a* and the first winding section-adjacent portion 1121*a*. The induction unit 130C may be made from any of the aforementioned materials previously described with respect to the induction unit 130A.

Since the induction unit 130C is positioned in the mounting space between the second winding section-adjacent portion 1111*a* and the first winding section-adjacent portion 1121*a*, the first coil and second coil 111, 112 can be coupled to each other by the induction unit 130C. That is, the induction unit 130C positioned between the first coil and second coil 111, 112 may be induced by a magnetic field generated between the first coil and second coil 111, 112. The induction unit 130C can mutually compensate a magnetic field induced from the first coil 111 and a self-magnetic field generated in the second coil 112, and can thereby increase the inductance of the inductor device 100. When an inductor device 100 has a 2-in-1 structure and is relatively small in size, as is the case of the inductor device 100, the induction unit 130C can be received in the mounting space between the second winding section-adjacent portion 1111*a* and the first winding section-adjacent portion 1121*a*, which results in no change in the size of the small-sized inductor device 100, but an increase in the inductance of the inductor device 100. Further, the inductor device 100 including the induction unit 130C can achieve a reduction in inductor voltage ripple as well as a reduction in inductor current ripple. Accordingly, the efficiency of the small-sized inductor device 100 including the induction unit 130C can be increased when compared to conventional small-sized inductor devices 100.

Figure 6A:
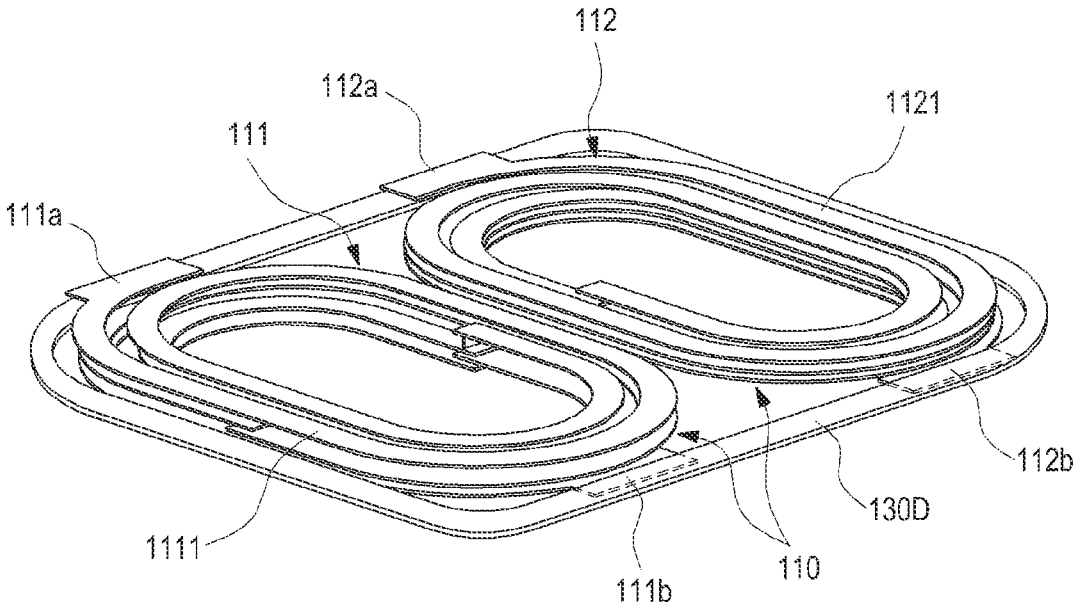
FIG. 6A is a perspective view illustrating the coil unit including an induction unit, according to an embodiment of the present invention.
Figure 6B:
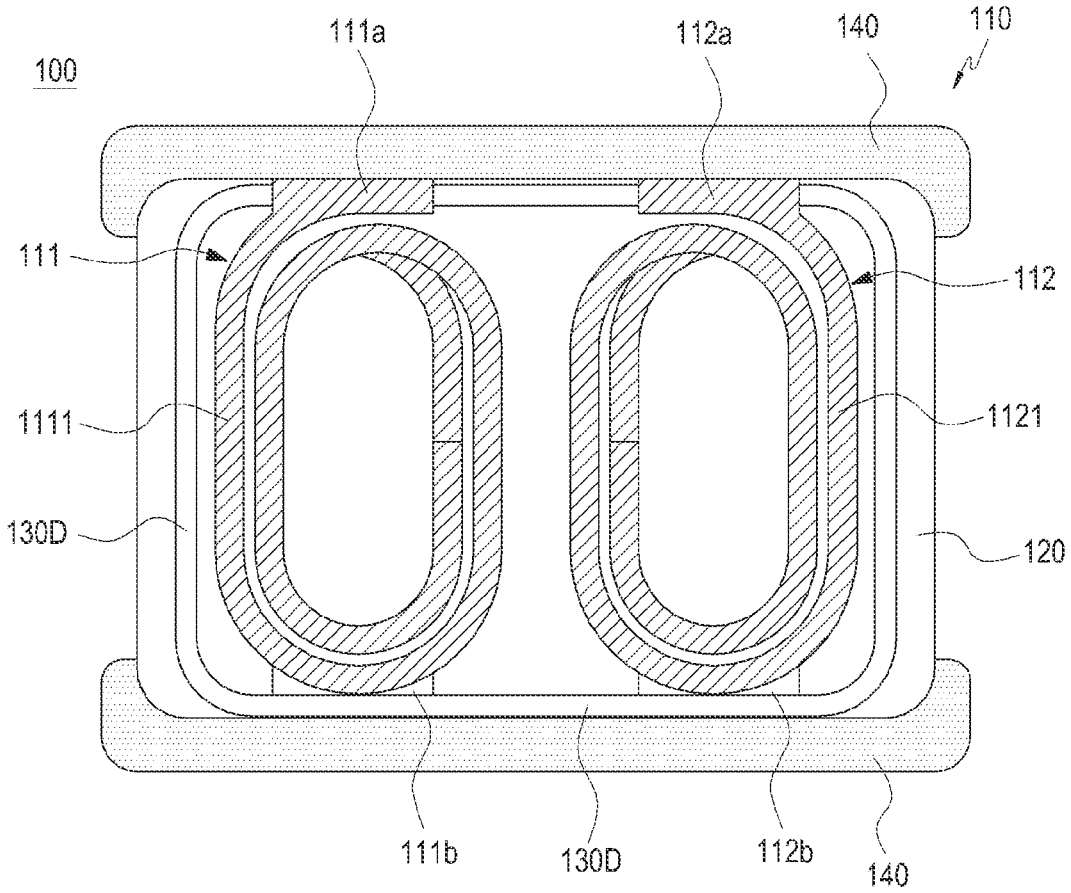
FIG. 6B is a plan view illustrating the inductor device including the coil unit and induction unit shown in FIG. 6A, according to an embodiment of the present invention.

FIG. 6A is a perspective view illustrating the coil unit 110 including an induction unit 130D and FIG. 6B is a plan view illustrating the inductor device 100 including the coil unit 110 and induction unit 130D shown in FIG. 6A, according to an embodiment of the present invention.

Referring to FIGS. 6A and 6B, the induction unit 130D may be formed as a ring-type coupling member in the shape of a closed loop around the outer circumference of the coil unit 110, particularly, an outer closed loop that has an inner space receiving the first coil and second coil 111, 112. The induction unit 130D is in the shape of an outer closed loop, surrounds the coil unit 110, and is positioned around the inner circumference of the core unit 120.

Since the induction unit 130D is positioned around the outer circumferences of the first coil and second coil 111, 112, a portion of the induction unit 130D, which is adjacent to the outer circumference of the first coil 111, can be induced by a magnetic field generated in the first coil 111, and a portion of the induction unit 130D adjacent to the outer circumference of the second coil 112 can be induced by a magnetic field generated in the second coil 112. The induction unit 130D may be made from the materials previously described with respect to the induction unit 130A.

Since the induction unit 130D surrounds the outer circumference of the coil unit 110 and is positioned adjacent to the outer circumferential surface of the coil unit 110, the first coil and second coil 111, 112 can be coupled to each other by the induction unit 130D. That is, a portion of the induction unit 130D adjacent to the outer circumference of the first coil 111 and a portion of the induction unit 130D adjacent to the outer circumference of the second coil 112 can be induced by a magnetic field generated between the first coil and second coil 111, 112. The induction unit 130D can mutually compensate a magnetic field induced from the first coil 111 and a self-magnetic field generated in the second coil 112, and can thereby increase the inductance of the inductor device 100. When an inductor device 100 has a 2-in-1 structure and is relatively small in size, as is the case of the inductor device 100, the induction unit 130D can be received in the space between the outer circumferential surface of the coil unit 110 and the inner circumferential surface of the core unit 120, which results in no change in the size of the small-sized inductor device 100, but an increase in the inductance of the inductor device 100. Further, the inductor device 100 including the induction unit 130D can achieve a reduction in inductor voltage ripple as well as a reduction in inductor current ripple. Accordingly, the efficiency of the small-sized inductor device 100 including the induction unit 130D can be increased when compared to conventional small-sized inductor devises.

Figure 7A:
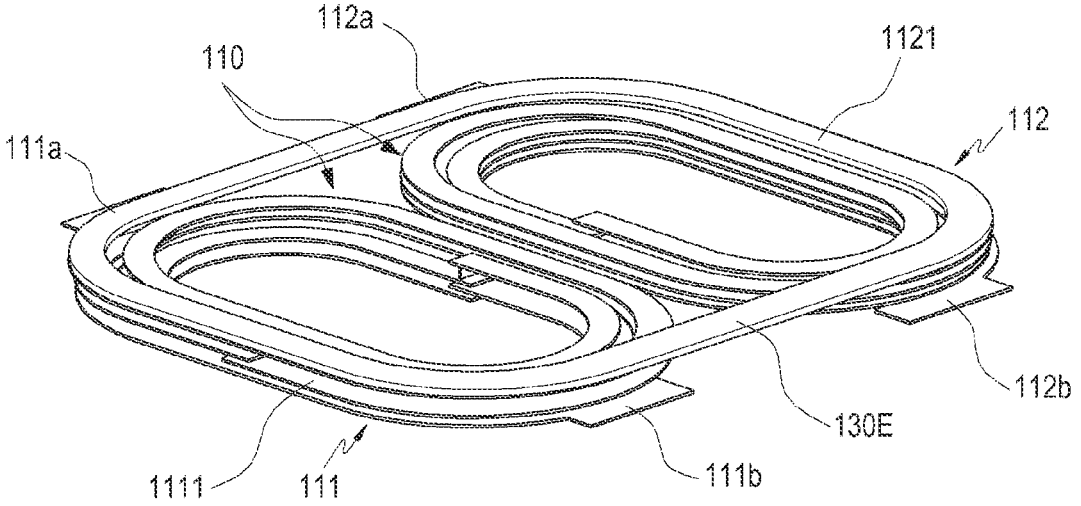
FIGS. 7A-7C are perspective views each illustrating the coil unit including an induction unit according to an embodiment of the present invention.
Figure 7B:
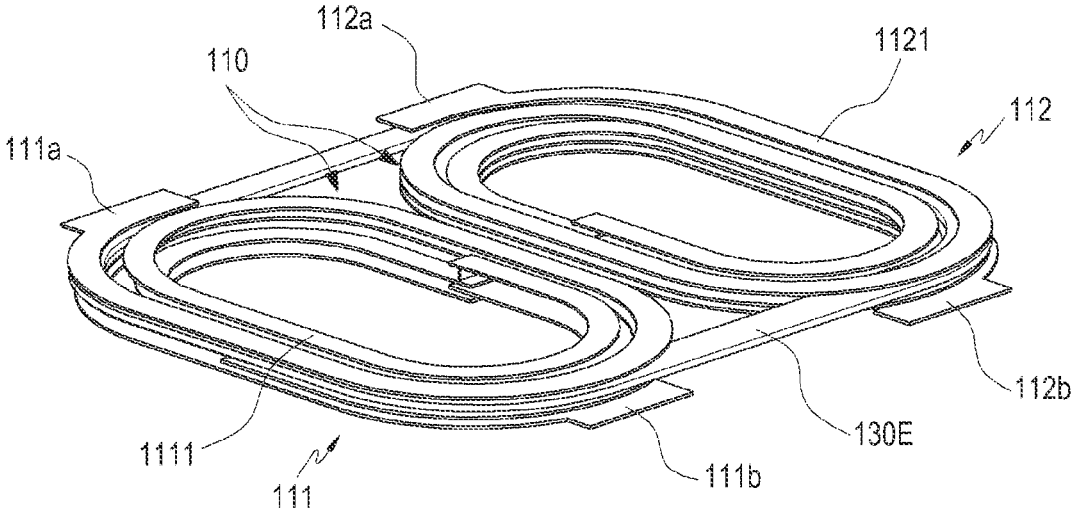
Figure 7C:
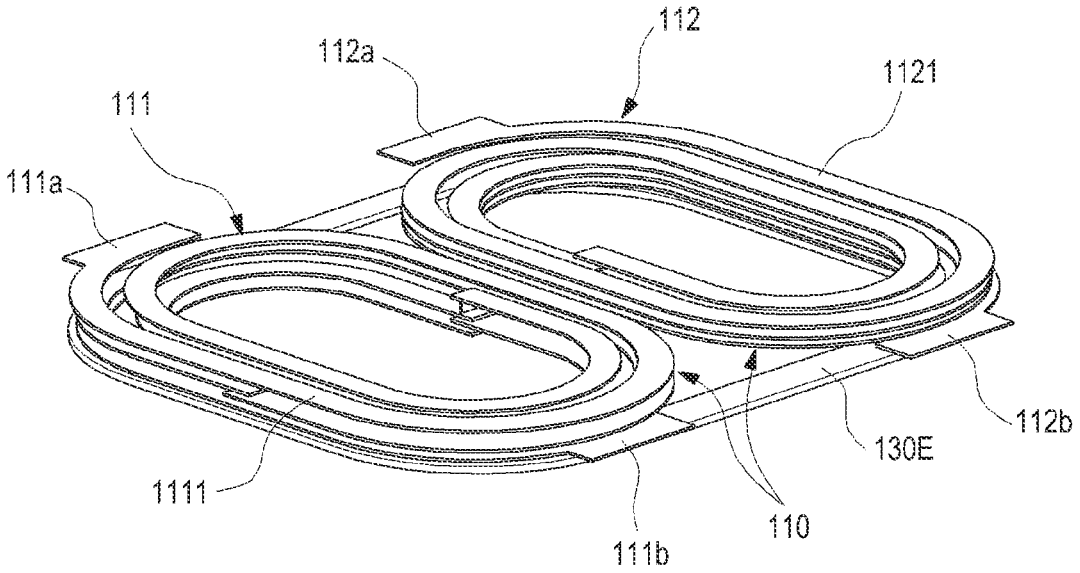

FIGS. 7A-7C are perspective views each illustrating the coil unit 110 including an induction unit 130E, according to an embodiment of the present invention.

Referring to FIGS. 7A-7C, the induction unit 130E may be formed as a ring-type coupling member 130E extending along the outermost winding section of the coil unit 110. The induction unit 130E may be positioned on the upper surface of the top outermost winding section (see FIG. 7A), on the lower surface of the bottom outermost winding section (see FIG. 7C), or between adjacent outermost winding sections (see FIG. 7B), and may be in the shape of a closed loop, particularly, an outer closed loop.

The induction unit 130E may be in the shape of an outer closed loop that is positioned on the upper surfaces of the top outermost winding sections 1111, 1121 of the first coil and second coil 111, 112, on the lower surfaces of the bottom outermost winding sections 1111, 1121 of the first coil and second coil 111, 112, or between adjacent outermost winding sections 1111, 1121 of the first coil and second coil 111, 112 and couples the first and second winding sections 1111, 1121 to each other.

Accordingly, the induction unit 130E may be positioned adjacent to the outermost winding section 1111 of the first coil 111 and the outermost winding section 1121 of the second coil 112. Accordingly, when current is applied to the first coil and second coil 111, 112, the induction unit E 130E may be induced by magnetic fields generated in the first and second coils 111, 112.

The induction unit 130E may be made from any of the previously described materials described with respect to the induction unit 130A.

Since the induction unit 130E is positioned on the upper surface of the top outermost winding section 1111, on the lower surfaces of the bottom outermost winding section 1111, or between adjacent outermost winding sections 1111 of the first coil 111, and is positioned on the upper surface of the top outermost winding section 1121, on the lower surfaces of the bottom outermost winding section 1121, or between adjacent outermost winding sections 1121 of the second coil 112, the first coil and second coil 111, 112 can be coupled to each other by induction unit 130E. That is, a portion of the induction unit 130E positioned on, under, or between the outermost winding sections 1111 and a portion of the induction unit 130E positioned on, under, or between the outermost winding sections 1121 can be induced by magnetic fields generated as current is applied to the first coil and second coil 111, 112. Accordingly, the induction unit 130E can mutually compensate a magnetic field induced from the first coil 111 and a self-magnetic field generated in the second coil 112, and can thereby increase the inductance of the inductor device 100. When an inductor device 100 has a 2-in-1 structure and is relatively small in size, as is the case of the inductor device 100, the induction unit 130E can be positioned on, under, or between the outermost winding sections 1111, 1121 of the first coil and second coil 111, 112, which results in no change in the size of the small-sized inductor device 100, but an increase in the inductance of the inductor device 100. Further, the inductor device 100 including the induction unit 130E can achieve a reduction in inductor voltage ripple as well as a reduction in inductor current ripple. Accordingly, the efficiency of the small-sized inductor device 100 including the induction unit 130E can be increased when compared to conventional small-sized inductor devices.

Figure 8A:
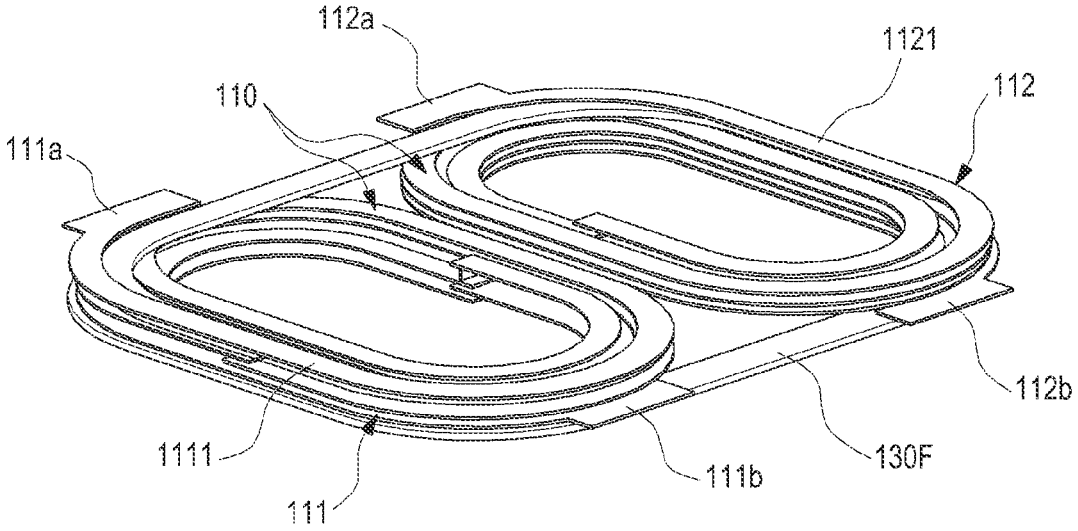
FIG. 8A is a perspective view illustrating the coil unit including an induction unit, according to an embodiment of the present invention.
Figure 8B:
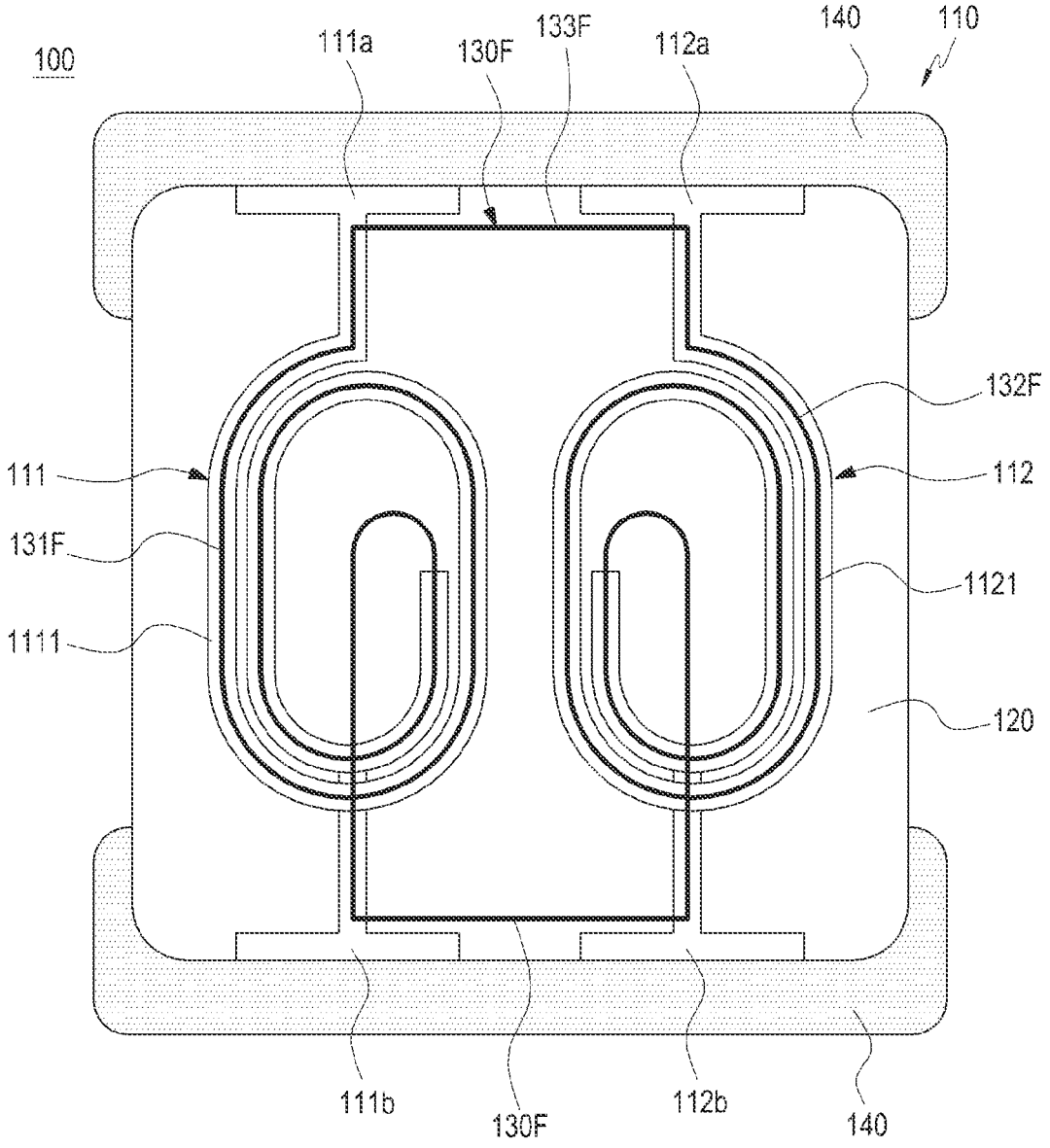
FIG. 8B is a plan view illustrating the inductor device including the coil unit and induction unit shown in FIG. 8A, according to an embodiment of the present invention.
Figure 8C:
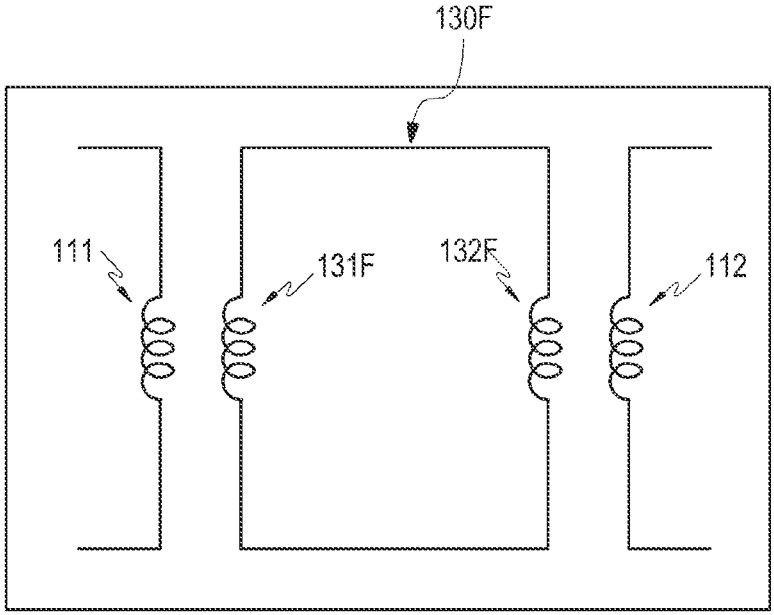
FIG. 8C is a schematic circuit diagram of the inductor device shown in FIG. 8A, according to an embodiment of the present invention.

FIG. 8A is a perspective view illustrating the coil unit 110 including an induction unit 130F, FIG. 8B is a plan view illustrating the inductor device 100 including the coil unit 110 and induction unit 130F shown in FIG. 8A, and FIG. 8C is a schematic circuit diagram of the inductor device 100 shown in FIG. 8A, according to an embodiment of the present invention.

Referring to FIGS. 8A-8C, the induction unit 130F is capable of being induced by a magnetic field and may be mounted on the coil unit 110 of the inductor device 100.

The induction unit 130F includes a first winding core 131F that is wound along the first winding section 1111 of the first coil 111 in the same manner as the first winding section 1111 and a second winding core 132F that is wound along the second winding section 1121 of the second coil 112 in the same manner as the second winding section 1121. Further, the first and second winding cores 131F, 132F may be connected to each other at the start and end points of the first coil and second coil 111, 112, thereby forming a closed loop.

The first winding core 131F may be wound such that it is placed from the start point to the end point of the first coil 111 along the first winding section 1111 wound in the counter-clockwise direction. Further, the second winding core 132F may be wound such that it is placed from the start point to the end point of the second coil 112 along the second winding section 1121 wound in the clockwise direction. In addition, portions of the first winding core positioned at the start and end points of the first coil 111 and portions of the second winding core positioned at the start and end points of the second coil 112 may be connected to each other, and therefore the first and second winding cores may form a closed loop.

Since the first winding core 131F is wound along the first winding section 1111, the first winding core 131F may be disposed adjacent to the respective wound or laminated portions of the first winding section 1111. Accordingly, when current is applied to the first coil 111 to thereby generate a magnetic field, the first winding core 131F adjacent to the respective portions of the first winding section 1111 can be induced by the magnetic field generated in the first winding section 1111.

Further, since the second winding core 132F is wound along the second winding section 1121, the second winding core 132F may be disposed adjacent to the respective wound or laminated portions of the second winding section 1121. Accordingly, when current is applied to the second coil 112 to thereby generate a magnetic field, the second winding core 132F adjacent to the respective portions of the second winding section 1121 can be induced by the magnetic field generated in the second winding section 1121.

The first and second winding cores 131F, 132F of the induction unit 130F may be made from the materials previously described with respect to the induction unit 130A.

Since the first and second winding cores 131F, 132F are wound along the first and second winding sections 1111, 1121 respectively and form a closed loop, the first and second winding cores 131F, 132F can be induced by a magnetic field generated between the first coil and second coil 111, 112.

Further, the first winding core 131F is induced by a self-magnetic field generated in the first coil 111 and a magnetic field induced from the second coil 112, the second winding core 132F is induced by a self-magnetic field generated in the second coil 112 and a magnetic field induced from the first coil 111, and these magnetic fields are mutually compensated in each of the first and second winding cores 131F, 132F. Accordingly, the inductance of the inductor device 100 can be increased. When an inductor device 100 has a 2-in-1 structure and is relatively small in size, as is the case of the inductor device 100, the first and second winding cores 131F, 132F that are placed in the positions of the first coil and second coil 111, 112 and thus couple the first coil and second coil 111, 112 can increase the inductance of the inductor device 100. Further, the inductor device 100 including the first and second winding cores 131F, 132F can achieve a reduction in inductor voltage ripple as well as a reduction in inductor current ripple. Therefore, the efficiency of a small-sized inductor device

100 can be increased through a simple structure such as the induction unit 130F. In addition, since the inductor device 100 including the induction unit 130F can be mounted in a small-sized electronic device with limited mounting space, such as a portable terminal device, efficiency of the electronic device is increased when compared to conventional electronic devices.

While the present invention has been shown and described with reference to certain embodiments thereof, it should be understood by those skilled in the art that many variations and modifications of the method and apparatus described herein will still fall within the spirit and scope of the present invention as defined in the appended claims and their equivalents.

What is claimed is:

1. An inductor device comprising:

a coil unit that includes a pair of first and second coils disposed adjacent to each other and coupled to each other;

a core unit that surrounds inner and outer spaces of the coil unit; and an induction unit that is disposed on the coil unit and is induced by a magnetic field generated between the first and second coils, wherein the induction unit includes a first winding core having a shape corresponding to a shape of winding sections of the first coil, and a second winding core connected to the first winding core and having a shape corresponding to a shape of winding sections of the second coil, wherein the first winding core and the second winding core are configured to form a closed loop, and wherein the induction unit is made from a material selected from the group consisting of ferrite, a metal alloy, and a combination thereof.

2. The inductor device of claim 1, wherein the induction unit is formed as a ring-type coupling member.

3. The inductor device of claim 2, wherein the ring-type coupling member comprises:

the first winding core that is wound along a winding section of the first coil; and the second winding core that is connected to start and end points of the first winding core and is wound along a winding section of the second coil.

4. An inductor device comprising:

a first coil that has a first winding section wound in a first direction;

a second coil that is disposed adjacent to the first coil and has a second winding section wound in a second direction that is opposite to the first direction of the first winding section;

a core unit that surrounds inner and outer spaces of the first and second coils; and an induction unit that is induced by a magnetic field generated between the first and second coils and is formed such that a first side of the induction unit is formed in the same shape as the first winding section of the first coil and is wound in the same direction as the first winding section of the first coil, a second side of the induction unit is formed in the same shape as the second winding section of the second coil and is wound in the same direction as the second winding section of the second coil, both the first and second sides of the induction unit are connected to each other between the first and second coils, and the first and second sides are configured to form a closed loop, wherein the induction unit is made from a material selected from the group consisting of ferrite, a metal alloy, and a combination thereof.

* * * * *